United States Patent [19]

Chang et al.

[11] Patent Number: 4,952,924

[45] Date of Patent: Aug. 28, 1990

[54] METHOD AND APPARATUS FOR ADDRESS CONVERSION IN A CHINESE CHARACTER GENERATOR OF A CRTC SCAN CIRCUIT

[75] Inventors: Chung-Chi Chang, Taipei; Hsi-Hung Fu, Hsin Chaung; Jia-Shyan Lee, Kao Hsiung City, all of Taiwan

[73] Assignee: Acer Incorporated, Taiwan

[21] Appl. No.: 221,087

[22] Filed: Aug. 22, 1988

[51] Int. Cl.[5] ..... G09G 1/00

[52] U.S. Cl. ..... 340/748; 340/750

[58] Field of Search ..... 340/732, 744, 745, 748, 340/789, 790, 794, 798, 799, 750

[56] References Cited

U.S. PATENT DOCUMENTS

| | | | |
|---|---|---|---|
| 4,228,430 | 10/1980 | Iwamura et al. | 340/750 |
| 4,246,578 | 1/1981 | Kawasaki et al. | 340/750 |
| 4,326,201 | 4/1982 | Enokizono | 340/750 |
| 4,404,552 | 9/1983 | Hirahata et al. | 340/750 |
| 4,415,890 | 11/1983 | Iwakura | 340/748 |
| 4,458,333 | 7/1984 | Smith | 340/748 |
| 4,527,154 | 7/1985 | Tanaka | 340/748 |
| 4,737,780 | 4/1988 | Ishii | 340/748 |
| 4,740,783 | 4/1988 | Lawrence et al. | 340/748 |
| 4,740,784 | 4/1988 | Fick | 340/748 |
| 4,772,883 | 9/1988 | Kitano | 340/748 |

*Primary Examiner*—Alvin Oberley
*Assistant Examiner*—Richard Hjerpe
*Attorney, Agent, or Firm*—Kirkland & Ellis

[57] ABSTRACT

In a CRTC scan circuit, a waste of memory space used in a character generator, such as a conventional Chinese character generator, during the scan can occur, thus an address conversion for a character generator is provided so that the memory space is completely utilized.

The procedure of address conversion is carried out by dividing the MASKROM memory space which is used in a character generator into two separate pluralities of partition groups according to a "character frame space" and an "actually used space" of a character, establishing an address mapping between those two partition groups, and determining an offset value between the input and output address data in this mapping. A general rule about the relation between these two partition groups is given and an address converter to perform the procedure is disclosed.

13 Claims, 4 Drawing Sheets

| PARTITION | FROM CODE BUFFER & CRTC | | CONVERT | TO 4M MASK ROM | |
|---|---|---|---|---|---|
| N0 | 0 | 31 | | 0 | 23 |
| N1 | 32 | 63 | | 24 | 47 |
| N2 | 64 | 95 | | 48 | 71 |
| N3 | 96 | 127 | | 72 | 95 |
| N4 | 128 | 159 | | 96 | 119 |
| N5 | 160 | 191 | | 120 | 143 |
| N6 | 192 | 223 | | 144 | 167 |
| N7 | 224 | 255 | | 168 | 191 |
| N8 | 256 | 287 | | 192 | 215 |
| N9 | 288 | 319 | | 216 | 239 |
| N10 | 320 | 351 | | 240 | 263 |
| N11 | 352 | 383 | | 264 | 287 |
| N12 | 384 | 415 | | 288 | 311 |
| ⋮ | | ⋮ | | ⋮ | ⋮ |

METHOD AND APPARATUS FOR ADDRESS CONVERSION IN A CHINESE CHARACTER GENERATOR OF A CRTC SCAN CIRCUIT

BACKGROUND OF THE INVENTION

The present invention is related to address conversion in a character generator used with a CRTC scan circuit so that the generator's memory space is completely utilized.

Nowadays, a 24×24 dot matrix Chinese character display system is widely used in Chinese or bilingual (Chinese/English) computers; in such a system, a lot of memory space is used in displaying Chinese characters and the Chinese character patterns are usually stored in nine 1 megabyte type MASKROM memory.

Referring to FIG. 1, an address signal (XAO~XA13) comes from a CPU (not shown) through an address bus 14 to a multiplexer 11. In addition, an address signal (MAO~MA13) comes from a cathode ray tube controller (CRTC) IO, which may be of the type 6845 produced by Motorola Inc., through an address bus 15 to the multiplexer 11. The output signal (BAO~BA13) of the multiplexer 11 passes through an address bus 16 to a code buffer 12, and then the output signal (CDO~CDl5) of the code buffer 12 passes through an address bus 17 to a nine 1 megabyte type MASKROM Chinese character generator 13. A row address signal (RAO~RA4) coming from the CRTC 10 directly passes to the Chinese character generator 13 through a row address bus 19. By combining the address bus 17 information CDO~CDl5 and the row address bus 19 information (RAO~RA4), the desired corresponding character data can be selected, and these character data (ROMDO~ROMD23) pass through a data bus 18 to a video circuit (not shown) to process and display.

As technology has progressed, memory circuits having larger storage capacity have been produced, for example, the new 4 megabyte type MASKROM: thus, the nine 1 megabyte type MASKROM currently used in a Chinese character generator can be replaced by only three 4 megabyte type MASKROM, and more Chinese character patterns can be stored in those three 4 megabyte type MASKROM. The result is that circuit board space and material cost can be reduced, and since the reliability is improved, maintenance costs can be saved, so the trend of using memory having larger storage capacity will continue in the future.

However, using memory having larger storage capacity also has a drawback caused by the limitation of the CRTC scan circuit: in order to match the same effect like the nine 1 megabyte type MASKROM, the three 4 megabyte type MASKROM will waste one-fourth of its memory space. Since a Chinese character pattern is often formed by a 24×24 dot matrix, with the character frame size being set as a 26×29 dot matrix, one Chinese character row must be scanned by 29 row address values, therefore the CRTC must supply 5 row address lines RAO~RA4 for the Chinese character generator's use.

Referring to FIG. 1 and FIG. 2, the address signal CDO~CD15 coming from the code buffer 12 selects each character memory address space a0~31, 32~63, 64~95, etc. within the character generator 13, and the row address signal RAO~RA4 coming from the CRTC IO scans within each character memory address space: the full range of row address values produced by the 5 scan lines RAO~RA4 is from 0 to 31 (since $2^5=32$). For example, in FIG. 2 a character memory address space 211 in the memory space 21 of a 4 megabyte type MASKROM Chinese character generator may have its row address range as 0~31, however, since a Chinese character actually only occupies 24 dots (e.g., row address range 0~23), the remaining 8 dots (row address range 24~31) are unused; this latter portion is shown by the address space 212. If the next Chinese character were simply to use the memory space 21 successively from the 24th dot (i.e., from row address 24), the CRTC row address counting would progress from the 24th dot until the 3lst dot was counted, then the row count would restart from 0, splitting the next Chinese character into two parts on the display screen. Thus, the row addresses for the next character can only start from row address 32, in the character memory address space 213, and not row address 24 (the row address counting restarting from 0), and the remaining 8 dots (row addresses 24~31 in space 212) must be discarded.

In short, the Chinese character pattern actually uses 24 dots, but the character frame space within the 4 megabyte type MASKROM is 32 dots, so causing much wasted space in the memory.

An address conversion procedure according to a preferred embodiment of the present invention intends to improve on the above-described waste of memory space. Referring to FIG. 3 an address converter 23 is inserted between the address buffer 20 and the 4 megabyte type MASKROM 21, so that the memory space is completely utilized.

SUMMARY OF THE INVENTION

The present invention can be embodied in a method for address conversion in an nxn dot-matrix character generator including a MASKROM memory, the character generator being used with a CRTC scan circuit having N row address scan lines wherein $2^N \geqq n$, comprising the steps of establishing a first plurality of first partition groups, each first partition group comprising $2^N$ row address values from the CRTC scan circuit and corresponding to a predetermined character; dividing the MASKROM memory into a second plurality of second partition groups, the second partition groups being in one-to-one correspondence with the first partition groups, each second partition group comprising n row address values, and the n row address values in each second partition group corresponding to the first n row address values in each corresponding first partition group; and subtracting an offset value from the first n row address values X in each first partition group to determine the n row address values in each second partition group, wherein the offset value is $(2^N-n)\mathrm{INT}(X/2^N)$. An address converter to perform the function of this rule is also provided.

BRIEF DESCRIPTION OF THE DRAWINGS

The present invention will be more fully understood from the following detailed description, taken in connection with the acco drawings in which.

DETAILED DESCRIPTION OF THE PREFERRED EMBODIMENT

Figure 1:
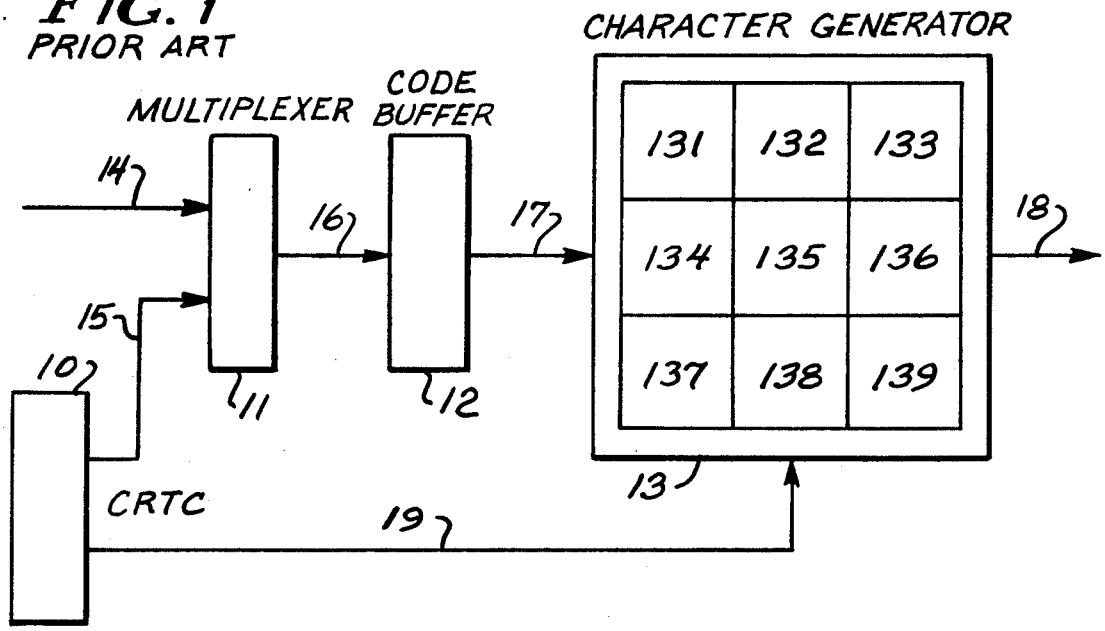
FIG. 1 PRIOR ART
FIG. 1 is a flow diagram of one conventional CRTC scan circuit using nine 1 megabyte type MASKROM in forming of the Chinese character generator.
Figure 2:
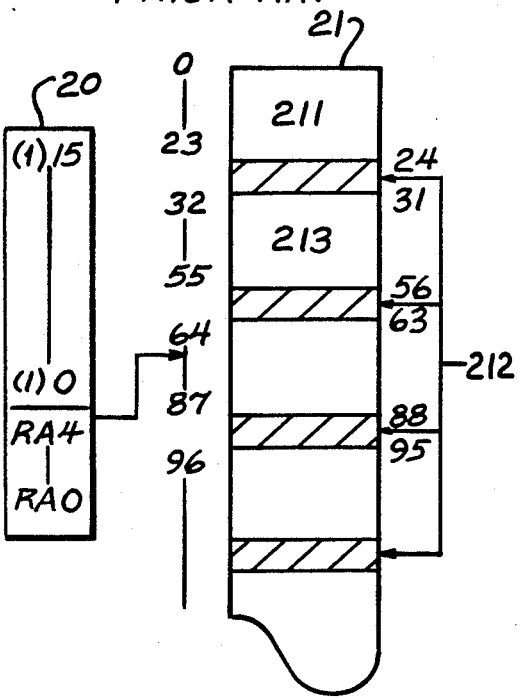
FIG. 2 PRIOR ART
FIG. 2 is a diagram of one conventional CRTC scan circuit using 4 megabyte type MASKROM and causing much wasted space in the memory.
Figure 3:
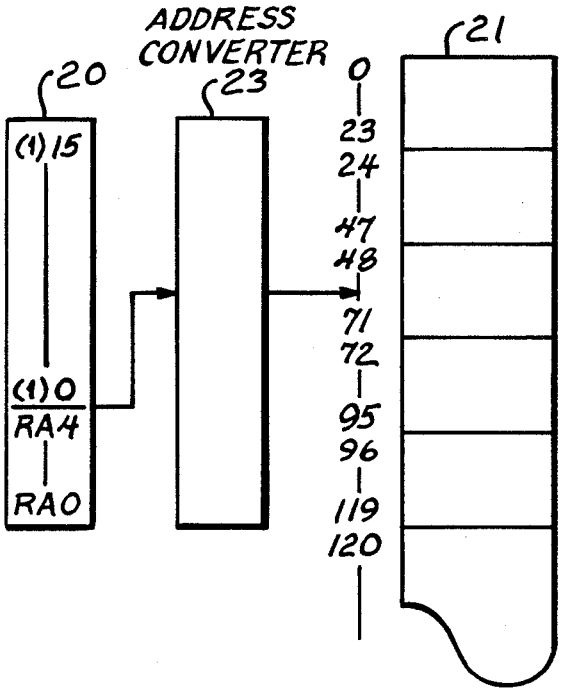
FIG. 3 is a diagram showing a CRTC scan circuit in accordance with the present invention completely utilizing the 4 megabyte type MASKROM memory space.
Figure 4:
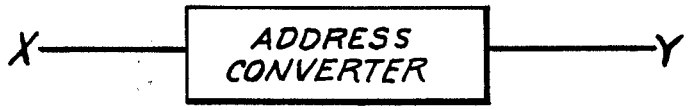
FIG. 4 is a memory address conversion table used in the present invention showing the relation between the addresses of each Chinese character frame and the corresponding addresses of the actual space occupied by each Chinese character.

The technical principle of address conversion involves establishing an address mapping table, as shown in FIG. 4, wherein X is the input address data which is converted into output address data Y by the address converter 23.

Figure 5:
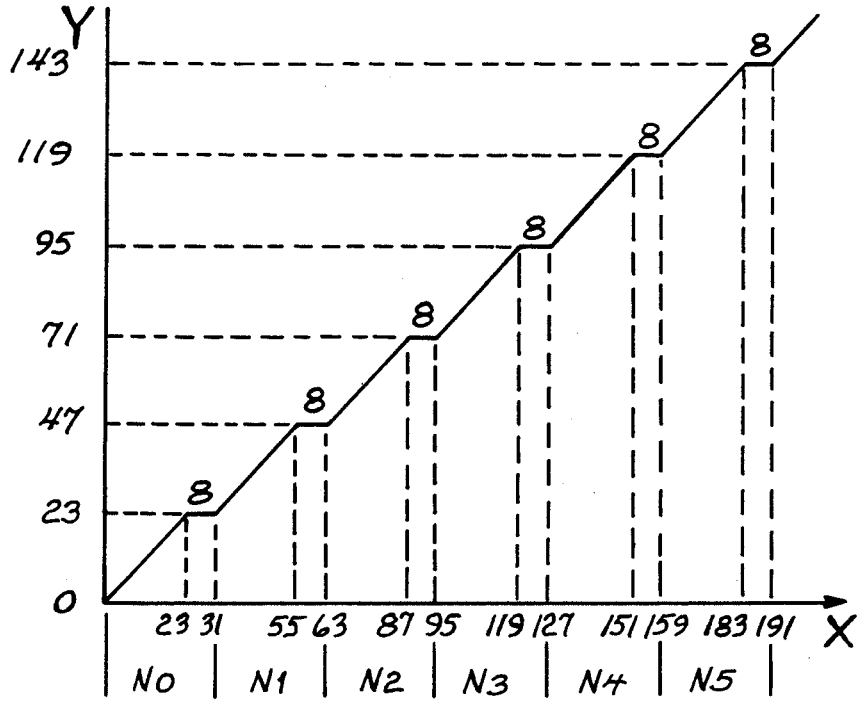
FIG. 5 is a diagram showing the input-output relations of the address conversion according to the data listed in FIG. 4.

FIG. 5 is a diagram showing a portion of the input-output address conversion relation according to the FIG. 4.

Referring to FIG. 5 for the NO partition, X is in the range 0~31 and maps to Y in the range 0~23; for the N1 partition, X is in the range 32~63 and maps to Y in the range 24~47; for the N2 partition, X is in the range 64~95 and maps to Y in the range 48~71; for the N3 partition, X is in the range 96~127 and maps to Y in the range 72~95; and for the N4 partition, X is in the range 128~159 and maps to Y in the range 96~119.

It will be noted that for the N1 partition, for all X except 56~63, if X1=32 it maps to Y1=24, X2=33 maps to Y2=25, etc., so there is an offset value between X and Y within a given partition. The offset value is given by X1−Y1=32−24=8 (and X2−Y2=33−25=8), so the offset value between X and Y is 8 within the N1 partition. In the same way, for the N2 partition, for all X except 88~95, the off-set value between X and Y is 16.

According to the above, for every partition and for all X in each partition except the last 8 input address data, the offset value between X and Y can be deduced, and it is thus possible to use a general rule to show the offset value between X and Y within each partition. That general rule is: the offset value=8INT(X/32), for all X except the last 8 input address data, wherein the notation INT(X/32) means the integer part of the value X divided by 32. Since Y can be obtained by subtracting the offset value from X, the whole address conversion rule is Y=X−8INT(X/32), for all X except the last 8 input address data within each partition.

The address conversion method of the present invention can be implemented by a hardware circuit address converter: the steps of generating the address converter are described as follows:

(1) INT(X/32)

The input address "X" is shifted right 5 bits (i.e., the value of X stored in a register is divided by 2 five times successively), then the integer part of X/32is taken, and named "W". (2) −8INT(X/32) or 8W The "W" is shifted left 3 bits (i.e., the value of W stored in a register is multiplied by 2 three times successively), and named the new value "C". (3) −8INT(X/32) or −C Because there is no logic circuit component for implementing the subtracting function, an adder is used since "adding a negative value" obtains the same effect as "subtracting a positive value"; thus, the 2's complement of "C" is taken, which can be obtained by inverting the bits of "C" and adding 1; this result is then named "B".

(4) X−8INT(X/32) or X +B

Adding the input address "X" and "B" in an adder produces the sum "Y" as the final result, i.e., the converted address, and the steps are completed.

It should be noted for the input address signal value represented by RAO~RA4 greater than or equal to 24 within each partition, namely, the above-described last 8 input address data within each partition, an incorrect value of Y will be produced. Thus, input address bits RA3 and RA4 should pass through an AND gate so as to disable the 8 integer address values which are greater than or equal to 24.

Figure 6:
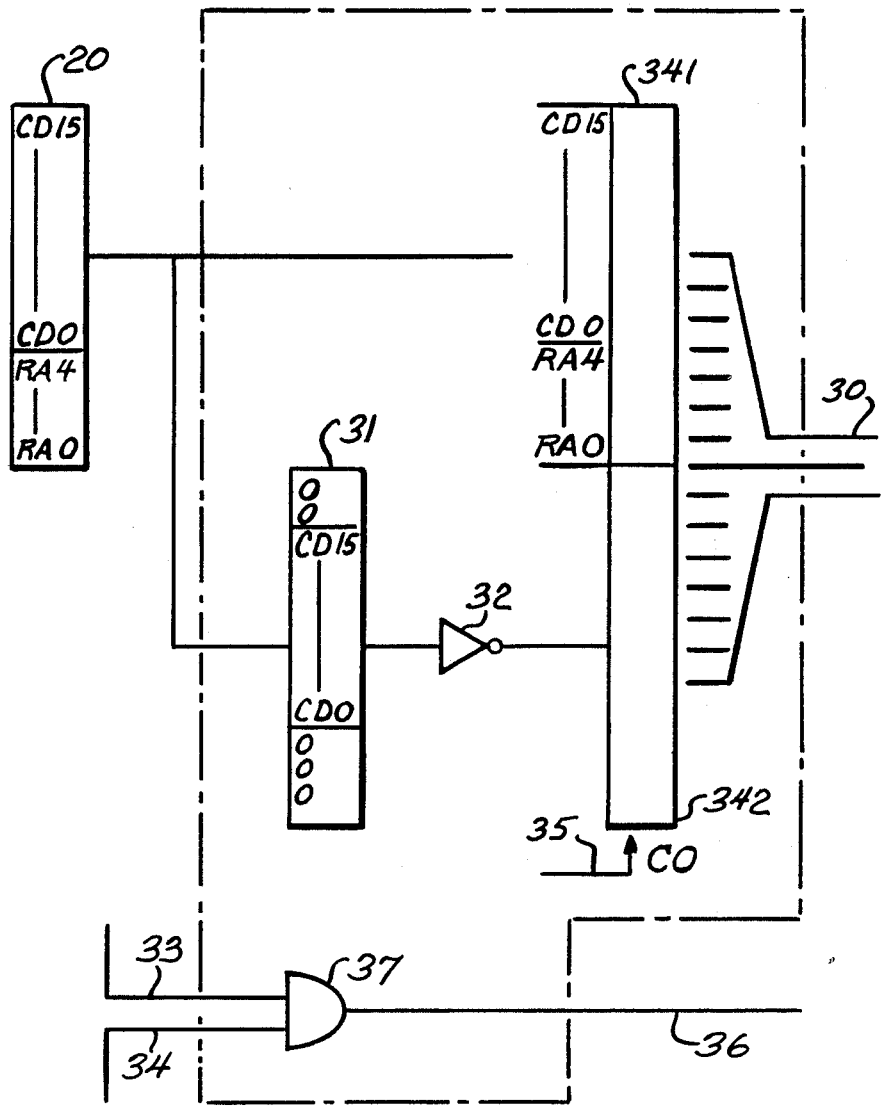
FIG. 6 is a schematic view of an address converter in accordance with the present invention, showing the processing steps of the address conversion.

A diagram of an address converter in accordance with the invention is shown as FIG. 6; referring to FIG. 6, let the composite address signal CD15~CDO and RA4~RAO stored in the address buffer 20 be X, which come from the code buffer 12 and CRTC 10 separately; send X to an adder register 341 (which may be of the type SN 74F283 produced by Texas Instruments Inc.). Let the data stored in register 31 be 8INT(X/32); this is the result of shifting X right 5 bits then shifting X left 3 bits. The data stored in register 31 is inverted by the inverter 32, and sent to the adder register 342, the carry input "co" 35 of the adder register 342 is activated (to obtain the effect of "add 1") simultaneously, thus the 2's complement of the data in register 31 can be obtained. Finally, the data stored in the adder register 341 and the adder register 342 are added and the result is sent to the 4 megabyte type MASKROM via address bus 30, and the function of address conversion is completed. As for the function of the disable line 36 of the AND gate 37, that is as described before, the line 33 is RA3 and line 34 is RA4, thus the 8 integer address values greater than or equal to 24 are disabled.

Figure 7:
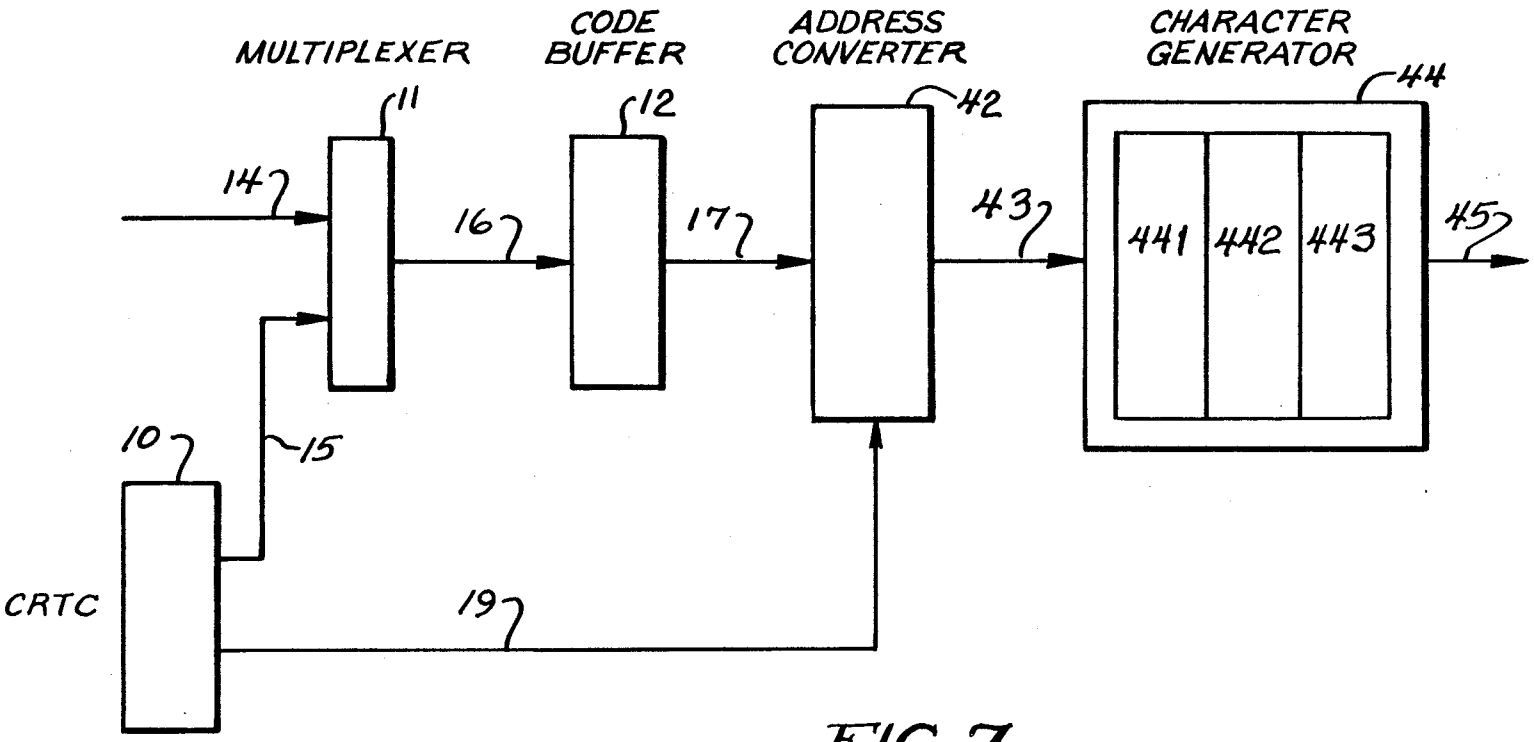
FIG. 7 is a flow diagram of a CRTC scan circuit in accordance with a preferred embodiment of the present invention using three 4 megabyte type MASKROM.

Referring to FIG. 7, wherein the block 42 is the address converter, the line 43 is the address bus POO~P2O, the block 44 is the three 4 megabyte type MASKROM 441, 442 and 443, and the line 45 is the address bus carrying character data ROMDO~-ROMD23 which are directed to the video circuit (not shown).

It will be understood that the basic principle of address conversion described above is applicable to any CRTC scan circuit with N row address scan lines and any nxn dot-matrix character generator (wherein $2^N \geqq n$), so long as Y=X−8INT(X/32) is replaced by $Y=X-(2^N-n)\ INT(X/2^N)$ for all X except the last $2^N-n$ input address data within each partition.

While the invention has been described in connection with a preferred embodiment, it is to be understood that the scope of the invention is not limited to the disclosed embodiment but on the contrary, covers various modifications and equivalent arrangements included within the spirit and scope of the appended claims, which scope is to be accorded the broadest interpretation so as to encompass all such modification and equivalent structures.

What is claimed is:

1. A method for address conversion in an nxn dotmatrix character generator including a MASKROM memory, the character generator being used with a CRTC scan circuit having N row address scan lines wherein $2^N \geqq n$, comprising the steps of:

establishing a first plurality of first partition groups, each first partition group comprising $2^N$ row address values X from the CRTC scan circuit and corresponding to a predetermined character:

dividing the MASKROM memory into a second plurality of second partition groups, the second partition groups being in one-to-one correspondence with the first partition groups, each second partition group comprising n row address values, and the n row address values in each second partition group corresponding to the first n row address values in each corresponding first partition group: and subtracting an offset value from the first n row address values X in each first partition group to determine the n row address values in each second partition group, wherein the offset value is $(2^N-n)\mathrm{INT}(X/2^N)$.

2. An apparatus for address conversion in an nxn dot-matrix character generator including a MASKROM memory, the generator being used in a CRTC scan circuit having N row address scan lines wherein $2^N \geqq n$, comprising:

means for converting an input row address value X from the CRTC scan circuit into an output row address value Y for accessing the MASKROM memory, wherein $Y=X-(2^N-n)\mathrm{INT}(X/2^N)$, the notation $\mathrm{INT}(X/2^N)$ being the integer part of the input row address value X divided by $2^N$: and first logic means for disabling a scan signal in the CRTC scan circuit when the input row address value X is greater than $2^N-n$.

3. The apparatus for address conversion according to claim 2, wherein said converting means comprises second logic means for inverting the input row address value, third logic means for shifting bits of the inverted input row address value and for adding the input row address value and the inverted input row address value.

4. The apparatus for address conversion according to claim 2, wherein said first logic means includes an AND gate.

5. The apparatus for address conversion according to claim 3, wherein said first logic means includes an AND gate.

6. The apparatus for address conversion according to claim 4, wherein said AND gate has two input lines, said two input lines being the most significant and the next most significant scan lines of said N row address scan lines.

7. The apparatus for address conversion according to claim 5, wherein said AND gate has two input lines, said two input lines being the most significant and the next most significant scan lines of said N row address scan lines.

8. The apparatus for address conversion according to claim 3, wherein said third logic means includes a plurality of logical addition devices for adding said inverted input row address value and said input row address value.

9. The apparatus for address conversion according to claim B, wherein said plurality of logical addition devices includes at least one logical addition device for adding said inverter input row address value and a plurality of less significant bits of said input row address value, said at least one logical addition device having its carry input activated.

10. The apparatus for address conversion according to claim 8, wherein said first logic means includes an AND gate.

11. The apparatus for address conversion according to claim 9, wherein said first logic means includes an AND gate.

12. The apparatus for address conversion according to claim 10, wherein said AND gate has two input lines, said two input lines being the most significant and the next most significant scan lines of said N row address scan lines.

13. The apparatus for address conversion according to claim 11, wherein said AND gate has two input lines, said two input lines being the most significant and the next most significant scan lines of said N row address scan lines.

* * * * *